US010238983B1

(12) United States Patent
Polk

(10) Patent No.: US 10,238,983 B1
(45) Date of Patent: Mar. 26, 2019

(54) SELF-RIGHTING TOY

(71) Applicant: Leisure, Inc., Eden Prairie, MN (US)

(72) Inventor: Louis Frederick Polk, St. Louis Park, MN (US)

(73) Assignee: Leisure, Inc., Eden Prairie, MN (US)

( * ) Notice: Subject to any disclaimer, the term of this patent is extended or adjusted under 35 U.S.C. 154(b) by 0 days.

(21) Appl. No.: 15/405,800

(22) Filed: Jan. 13, 2017

(51) Int. Cl.
*A63H 15/08* (2006.01)
*A63H 15/06* (2006.01)

(52) U.S. Cl.
CPC ..... *A63H 15/06* (2013.01)

(58) Field of Classification Search
CPC ..... A63H 11/00; A63H 15/00; A63H 15/08; A63H 29/08; A63H 33/00
USPC ..... 446/168, 236, 269, 324, 431, 369
See application file for complete search history.

(56) References Cited

U.S. PATENT DOCUMENTS 1,150,761 A * 8/1915 Hartman ..... A63F 7/044 273/112
1,254,428 A * 1/1918 Myers ..... A63H 11/08 43/42.31
2,585,780 A * 2/1952 Johnson ..... A63H 15/08 446/324
2,942,379 A 6/1960 Oman et al.
3,039,228 A 6/1962 Mazzadra
3,449,858 A 6/1969 Balleis
3,519,273 A * 7/1970 Viby ..... A63H 15/08 446/431
3,638,350 A 2/1972 Wiggen
3,805,444 A 4/1974 Adickes
4,015,365 A * 4/1977 Stubbmann ..... A63H 1/20 446/258
4,084,811 A 4/1978 Kyo
4,205,483 A 6/1980 Clark et al.
4,211,408 A 7/1980 Tickle
4,213,266 A * 7/1980 Hyland ..... A63H 15/08 446/431
4,238,904 A * 12/1980 Lang ..... A63F 7/40 446/168
4,314,422 A * 2/1982 Wexler ..... A63H 15/08 446/269
4,411,096 A 10/1983 Smith
4,429,487 A * 2/1984 Taylor ..... A63B 21/0608 446/168
4,537,402 A 8/1985 Pranther, Jr.
4,575,353 A 3/1986 Perkitny
4,708,686 A 11/1987 Smith
4,770,412 A 9/1988 Wolfe
4,921,458 A 5/1990 Greenwood
4,952,191 A 8/1990 Martinez
5,056,789 A 10/1991 Talbot
(Continued)

*Primary Examiner* — Alexander Niconovich
(74) *Attorney, Agent, or Firm* — Haugen Law Firm PLLP

(57) ABSTRACT

A wobbling toy is configured to spontaneously re-orient itself in an upright position solely under the force of gravity. The self-righting toy includes a weight that is confined to and movable along a pathway such that the weight defines a dynamic mass that is sufficient to cause the housing to spontaneously pivot along a convex outer surface profile in coordination with a position of the weight in the pathway. The self-righting toy is configured to maintain a positional relationship of the weight so that the housing is spontaneously pivotable along the convex surface without external force supplied by a user.

25 Claims, 5 Drawing Sheets

(56) References Cited

U.S. PATENT DOCUMENTS 5,100,360 A 3/1992 Entzel
5,137,281 A 8/1992 Lehmann et al.
5,356,330 A 10/1994 Cohen
5,572,955 A * 11/1996 Boshears ..... A01K 15/025 119/706
5,575,702 A * 11/1996 Silvious ..... A63H 15/08 446/324
5,579,725 A 12/1996 Boshears
5,653,171 A * 8/1997 LeBron ..... A63F 7/3622 104/53
5,720,644 A * 2/1998 Ku ..... A63H 11/00 446/175
5,924,908 A * 7/1999 O'Heir ..... A63H 33/00 119/707
6,095,891 A 8/2000 Hoeting et al.
6,217,408 B1 * 4/2001 Willinger ..... A01K 15/025 119/707
6,237,538 B1 5/2001 Tsengas
6,273,779 B1 8/2001 Boulaire
6,322,071 B1 11/2001 Chaaban
6,405,682 B1 * 6/2002 Simon ..... A01K 15/025 119/707
6,484,671 B2 11/2002 Herrenbruck
6,485,349 B1 * 11/2002 Snyder ..... A63H 29/08 446/168
6,530,499 B1 3/2003 Coleman et al.
6,604,489 B2 8/2003 Wilkes et al.
6,945,195 B1 * 9/2005 Morrison ..... A01K 15/025 119/707
6,990,762 B1 * 1/2006 Muday ..... A01K 15/025 119/707
7,320,296 B2 * 1/2008 Morrison ..... A01K 15/025 119/707
7,905,491 B2 3/2011 Gray
7,971,556 B2 7/2011 Wechsler
8,528,854 B2 * 9/2013 Yan ..... A63H 27/12 244/119
8,858,292 B2 * 10/2014 Liao ..... A63H 1/02 446/324
9,233,313 B2 1/2016 Olivera et al.
9,352,237 B1 * 5/2016 Middleton ..... A63H 15/08
2004/0185746 A1 9/2004 Kaneko et al.
2008/0230012 A1 9/2008 Woltmann et al.
2011/0265374 A1 * 11/2011 Tompkins, IV ..... A01G 13/10 47/31.1
2012/0298044 A1 11/2012 Dotterer
2014/0060451 A1 * 3/2014 Oblack ..... A01K 15/025 119/709
2014/0115896 A1 * 5/2014 Ren ..... B60K 8/00 29/897.2
2014/0367284 A1 12/2014 Wurth et al.
2016/0081305 A1 * 3/2016 Williams ..... A01K 15/026 119/709
2016/0113241 A1 4/2016 Valle
2016/0236071 A1 8/2016 Rrabin
2016/0279531 A1 * 9/2016 Floyd ..... A63H 11/20

* cited by examiner

SELF-RIGHTING TOY

FIELD OF THE INVENTION

The present invention relates to child toys generally, and more particularly to a wobbling toy that is arranged to wobble and raise upright solely under gravitational forces when positioned on a flat surface.

BACKGROUND OF THE INVENTION

Toys that have wobbling and/or self-righting movements through specific placement or controlled movement of the center of gravity of the toy have been previously developed. Well-known examples of such toys include the "jumping bean" toy, and self-righting game pieces and boxing or martial arts equipment. In most cases, however, such toys and equipment require an external force impulse provided by a user to initiate movement. In other cases, such toys or equipment have limited range of motion, and do not truly "wobble" about many pivot axes.

It is therefore an object of the present invention to provide a toy that spontaneously pivots upright and wobbles solely under gravitational force when placed on a flat horizontal surface.

SUMMARY OF THE INVENTION

By means of the present invention, a wobble toy may spontaneously upright itself solely under gravitational force, and without an external force applied by a user. The toy of the present invention therefore is capable of altering its orientation spontaneously when placed upon a horizontal surface. An example play action of the present toy may include placing the toy with its base in contact with a flat horizontal surface, and thereafter permitting the toy to orient itself without further user interaction. As a result of the geometry and mass distribution of the toy, gravitational force itself will cause the toy to re-orient into an upright condition. Force input by the user to the toy may result in a "wobble" in which the toy spontaneously pivots about multiple pivot axes.

In one embodiment, the self-righting toy of the present invention includes a housing having a housing axis defining an axial direction and a radial direction, with the housing having a convexly curved outer surface and defining a chamber. A wall at least in part defines an endless pathway extending around the housing axis in the chamber, and a weight is confined to and is movable along the endless pathway. The housing and the weight together define an arcuate tip boundary, such that when the center of gravity of the weight is disposed radially outwardly from the arcuate tip boundary, the housing is spontaneously pivotable on a curved outer surface about one or more pivot axes under solely gravitational force. The endless pathway is configured to maintain the center of gravity of the weight radially outward from the arcuate tip boundary.

In another embodiment, the self-righting toy includes a housing having a housing axis defining an axial direction and a radial direction, with the housing having a base and a peripheral portion extending curvilinearly from a border of the base to form a convex profile, the housing defining a chamber. An annular wall extends at least partially circumaxially about the housing axis, and at least in part defines a planar endless pathway extending around the housing axis in the chamber. A weight is confined to and is movable along the endless pathway, with the weight defining a dynamic mass that is sufficient to induce the housing to spontaneously pivot along the convex profile in coordination with a position of the weight in the endless pathway. The position of the weight is maintained by the endless pathway to continuously maintain a tip condition in which the housing is spontaneously pivotable along the convex profile.

In another embodiment, the self-righting toy includes a housing having a housing axis defining an axial direction and a radial direction, with the housing having a convex outer surface, and said housing defining a chamber. A channel extends at least partially about the housing axis in the chamber, and defines a substantially planar arcuate pathway in said chamber. A weight is movably disposed in the channel, with the channel being configured to define movement of the weight to along the defined pathway. The movable weight is a dynamic mass that is sufficient to induce the housing to spontaneously pivot along the convex outer surface in coordination with a position of the weight along the defined pathway. The position of the weight is maintained by the channel to continuously maintain a tip condition in which the housing is spontaneously pivotable along the convex outer surface.

DETAILED DESCRIPTION OF THE PREFERRED EMBODIMENTS

Figure 1A:
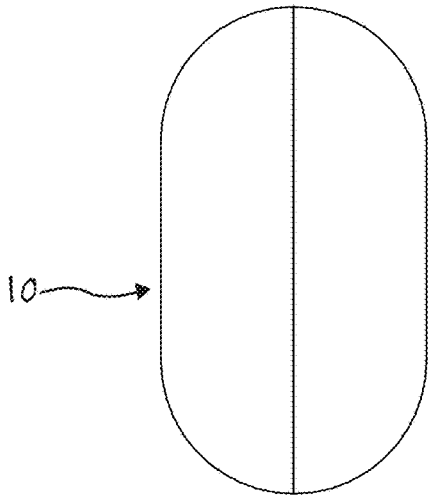
FIG. 1A is a left side elevational view of a self-righting toy of the present invention.
Figure 1B:
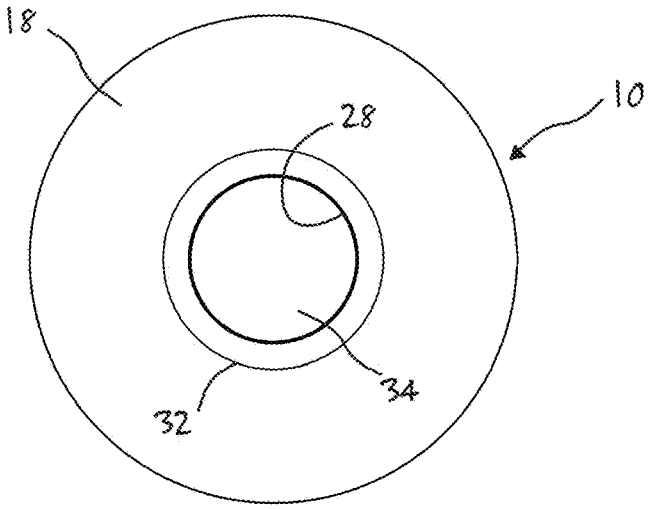
FIG. 1B is a top plan view of a self-righting toy of the present invention.
Figure 1C:
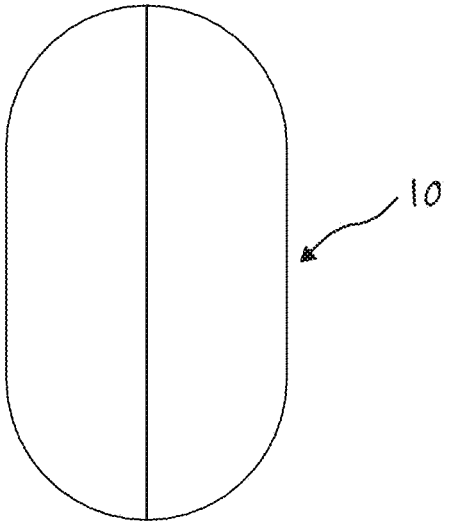
FIG. 1C is a right side elevational view of a self-righting toy of the present invention.

The objects and advantages enumerated above together with other objects, features, and advances represented by the present invention will now be presented in terms of detailed embodiments described with reference to the attached drawing figures which are intended to be representative of various possible configurations of the invention. Other embodiments and aspects of the invention are recognized as being within the grasp of those having ordinary skill in the art.

Unless otherwise apparent or stated, directional references, such as "upper", "lower", "interior", "exterior", "top", "bottom", "vertical", "horizontal", and the like are intended to be relative to the orientation of a particular embodiment of the invention as shown in the figures. In addition, a given reference numeral in the drawings indicates the same or similar structure when it appears in different figures, and like reference numerals identify similar structural elements and/or features of the subject invention.

One embodiment of the present invention is illustrated in the figures, with FIGS. 1A-1D illustrating left, top, right, and front views, respectively, of a self-righting toy 10 of the present invention. FIG. 2 illustrates toy 10 in an exploded view, with housing 12 separated to reveal a chamber 16 defined within housing 12. As further illustrated in FIG. 2, housing 12 includes a housing axis 14 that defines an axial direction 20, and a radial direction 22.

In some embodiments, housing 12 may substantially take the shape of a torus with a peripheral portion 18 at least partially surrounding a core region 24, which may be open to upper and lower sides 26*a*, 26*b* of housing 12, but circumaxially bounded by an annular wall 28. In other embodiments, the substantially torus-shaped housing 12 may be closed, with core region 24 bounded by annular wall 28 and upper and lower cover surfaces (not shown).

Figure 1D:
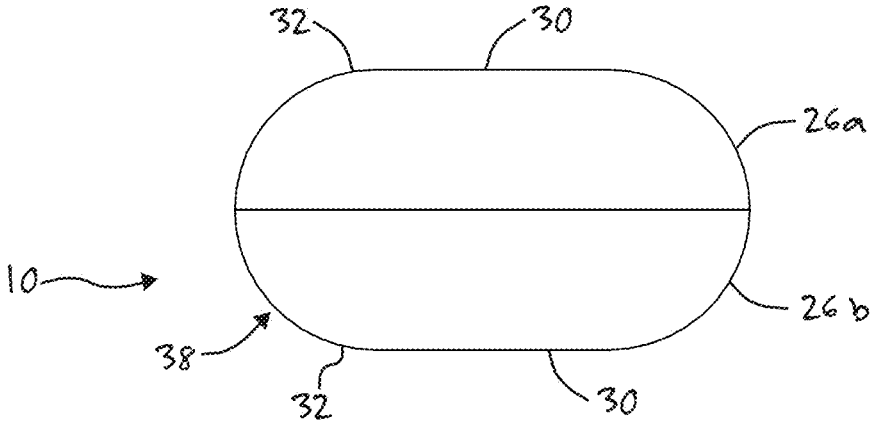
FIG. 1D is a front elevational view of a self-righting toy of the present invention.
Figure 2:
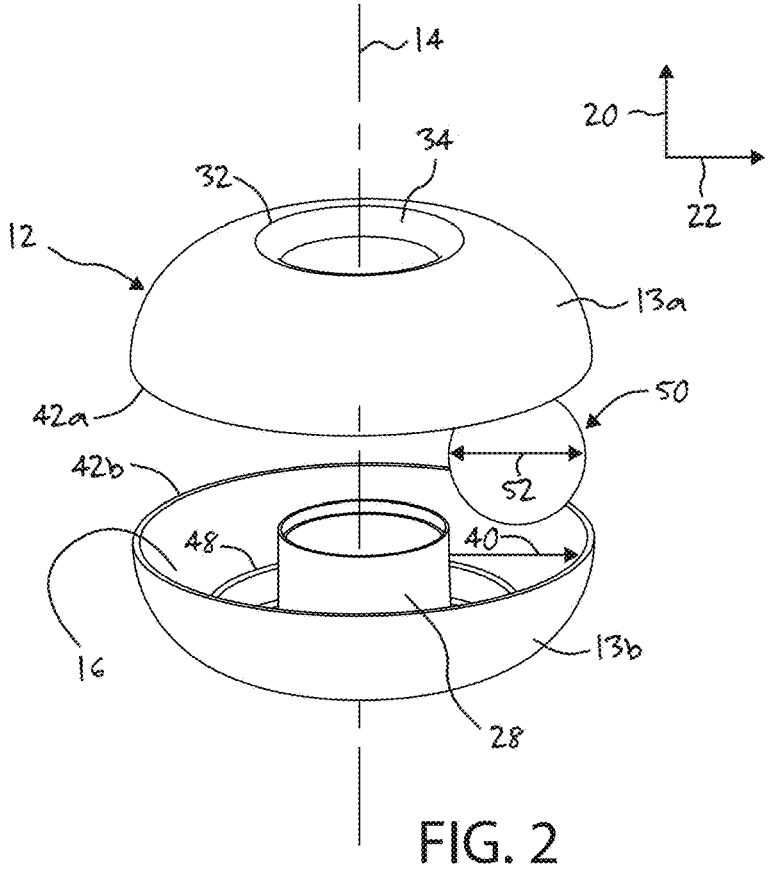
FIG. 2 is an exploded perspective view of a self-righting toy of the present invention.
Figure 3A:
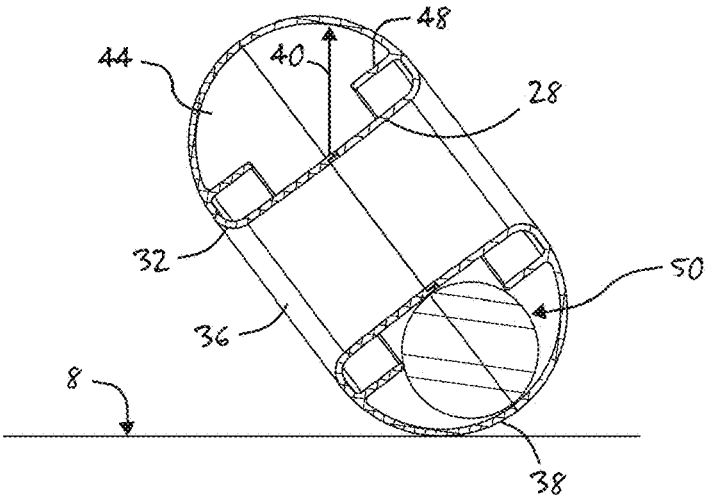
FIG. 3A is a cross-sectional view of a self-righting toy of the present invention in a tipped condition.
Figure 3B:
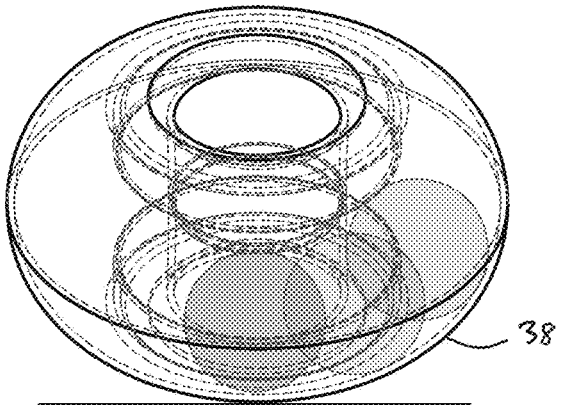
FIG. 3B is a transparent perspective view of a self-righting toy of the present invention in a tipped condition.

As shown in the front elevational view of FIG. 1D, the open or closed substantially torus-shaped housing 12 may define a base 30, either as an imaginary plane extending from a border 32 across a respective upper or lower axial opening 34, 36, or a planar surface at least partially closing a respective upper or lower axial opening 34, 36. Peripheral portion 18 of housing 12 extends curvilinearly outwardly from border 32 to form a convex profile 38, which may exhibit a constant or non-constant radius of curvature 40.

In the illustrated embodiment, housing 12 is formed from separable first and second portions 13*a*, 13*b*, together defining the substantially torus-shaped housing 12. In this embodiment, first and second portions 13*a*, 13*b* may be substantially mirror images of one another, securable to each other at respective equator surfaces 42*a*, 42*b*. It is contemplated, however, that first and second housing portions 13*a*, 13*b* need not be mirror images of one another, and may instead be configured to accommodate various applications. For example, it is contemplated that first portion 13*a* may be configured to signify or depict a game piece, character, shape, or other arrangement, with or without a curved convex surface portion. Therefore, for the purposes of the present invention, only a portion of housing 12 may be provided with the curved outer surface to permit the pivoting "wobble" motion as described herein.

Housing 12 preferably defines a chamber 16 that is preferably enclosed. Annular wall 28 may, at least in part, define a pathway 44 extending circumaxially around housing axis 14 in chamber 16. In the illustrated embodiment, pathway 44 is endless in circumaxially surrounding housing axis 14. Such an endless pathway 44 may be circular, or otherwise configured about housing axis 14 in chamber 16. In other embodiments, however, pathway 44 may define less than a complete loop. Pathway 44 may be arcuate at least partially about housing axis 14, and may be substantially planar.

As illustrated in FIGS. 3-6, a weight 50, such as one or more balls, may be confined to, but movably disposed in and along pathway 44. Therefore, weight 50 is contained within a specific pathway, and is able to circumnavigate housing axis 14 by being freely movable along the defined pathway 44 in chamber 16.

In the illustrated embodiment, annular wall 28 forms a part of housing 12, and is integrally formed therewith to establish a boundary between chamber 16 and the external environment. It is contemplated, however, that annular wall 28 may instead be disposed in chamber 16 as either a structurally separate or integrally formed body to partially or completely separate respective regions of chamber 16. Annular wall 28 may be substantially planar or non-planar, and may be preferably arranged with respect to peripheral portion 18 of housing 12 to define pathway 44 with a dimension, such as a radial pathway dimension 46, that substantially confines or constrains movement of weight 50 along pathway 44. In the illustrated embodiment, radial pathway dimension 46 may be substantially equal to, but only slightly larger than a diameter 52 of weight 50. Thus, weight 50 may be confined between annular wall 28 and another surface, such as the curved peripheral portion 18 of housing 12. In some embodiments, one or more stub walls 48 may extend into chamber 16 to further constrain weight 50 in its movement along pathway 44. Annular wall 28, stub walls 48, and peripheral portion 18 of housing 12 may, in some embodiments, form a channel 51 that is configured to constrain weight 50 to a substantially planar path of travel along pathway 44. Channel 51 may be formed from various structure, such as housing 12, annular wall 28, stub wall 48, and/or other structure in or defining chamber 16. An example planar path of travel for weight 50 along pathway 44 is circular. It is contemplated that weight 50 may roll, slide, tumble, or otherwise freely move along pathway 44, as described above.

Weight 50 may include one or more separate or connected weight elements that together define a mass with a weight center of gravity. Because weight 50 is freely movable along pathway 44, weight 50 may define a dynamic mass that alters the behavior of self-righting toy 10, depending upon the position of weight 50 along pathway 44.

As illustrated in FIGS. 3-6, weight 50 and housing 12 together define an arcuate tip boundary 60, beyond which the presence of the weight center of gravity causes housing 12 to pivot along the convex profile 38 of peripheral portion 18 of housing 12. In the illustrated embodiment, the convexly-curved peripheral portion 18 has a constant radius of curvature 40 to form a circular cross-sectional periphery region 62, as shown in the cross-sectional views of FIGS. 5 and 6. In this embodiment, arcuate tip boundary 60 is the center line of circular cross-sectional periphery region 62. Arcuate tip boundary 60 may preferably be adjacent to, or intersect with border 32 of base 30, wherein the convexly-curved outer surface of peripheral portion 18 extends from an intersection of arcuate tip boundary 60 and housing 12.

Figure 4:
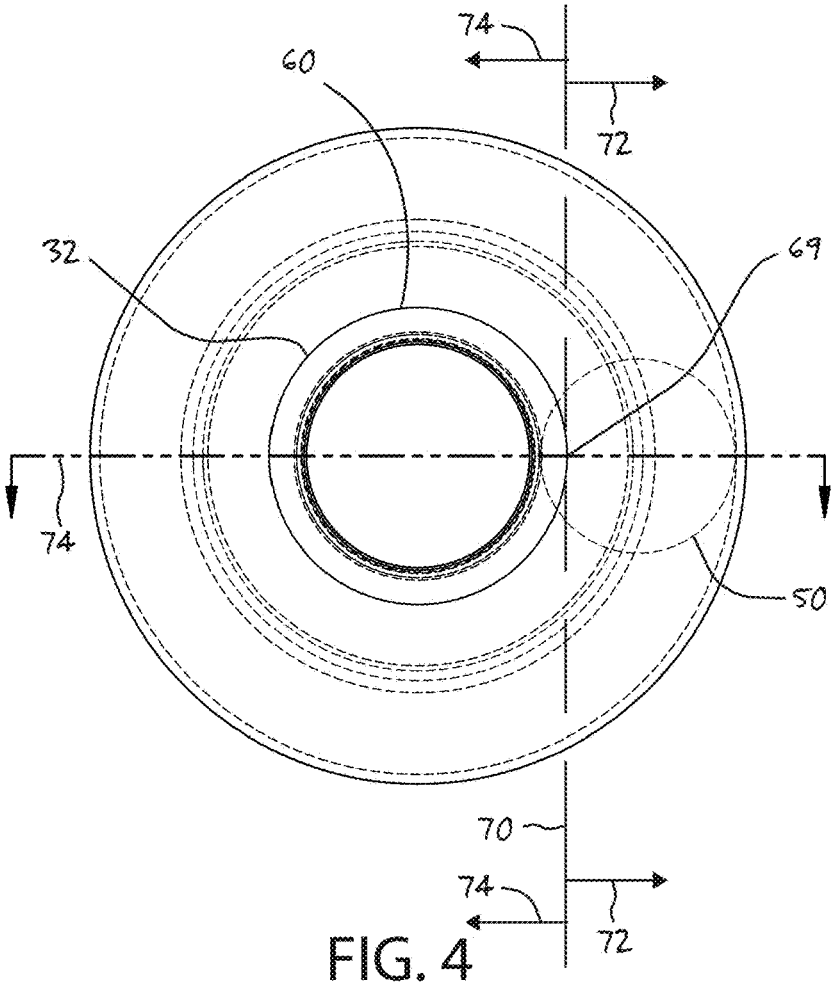
FIG. 4 is a transparent top plan view of the self-righting toy of the present invention.
Figure 5:
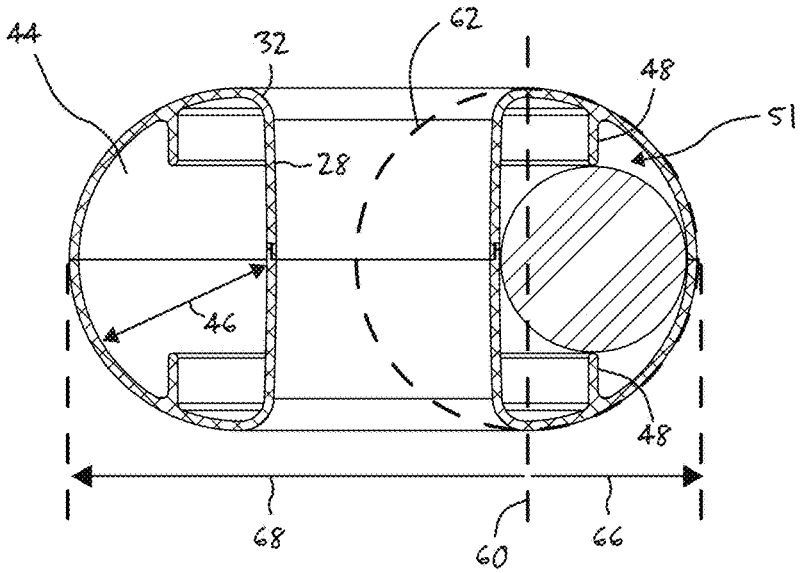
FIG. 5 is a cross-sectional view of the self-righting toy of FIG. 4, taken along cut line 74, and illustrated in a non-tipped condition.
Figure 6:
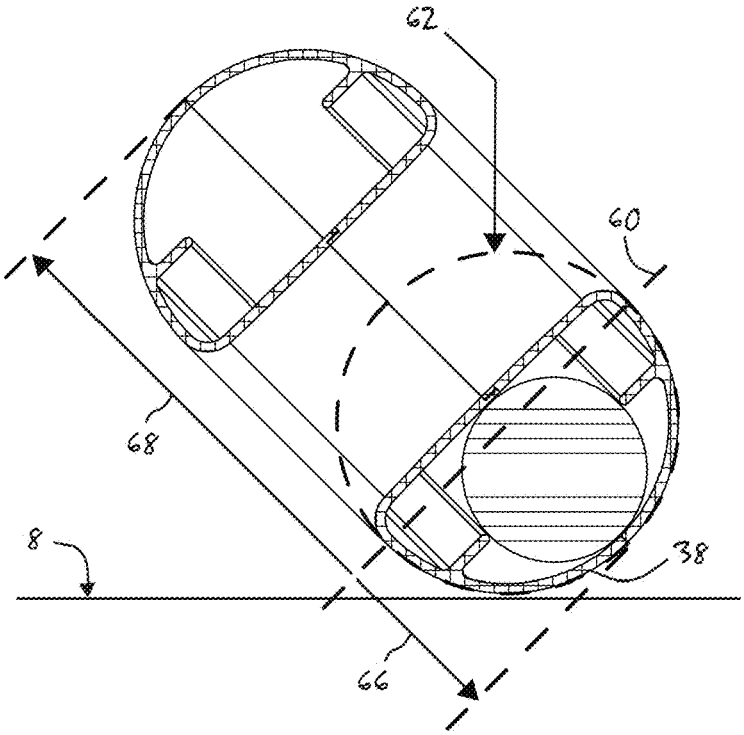
FIG. 6 is a cross-sectional view of the self-righting toy of FIG. 4 taken along cut line 74, and illustrated in a tipped condition.

In order to obtain the desired spontaneous pivoting of self-righting toy 10, a mass imbalance must be present with respect to arcuate tip boundary 60. In particular, a tip mass 66 exceeds a remainder mass 68. In some embodiments, tip mass 66 may be substantially equal to remainder mass 68, so that a driving force for pivoting self-righting toy 10 is minimized, leaving self-righting toy 10 with a tendency to only slowly "wobble" or pivot upright as a result of the slightly higher tip mass 66 as compared to the remainder mass 68. For the purposes hereof, the tip mass 66 may constitute a total of the mass of weight 50 and housing 12 radially outward from a tip plane 70 that intersects a tangent point 69 of arcuate tip boundary 60, and is perpendicular to a cross-sectional plane 74 that passes through a center of gravity of weight 50. As illustrated in FIG. 4, for example, arcuate tip boundary 60 may be substantially circular and coincident with, or adjacent to, border 32, with tip plane 70 intersecting tip boundary 60 at a tip boundary tangent point 69, and perpendicular to a cross-sectional plane 74 that passes through a center of gravity of weight 50. FIGS. 5 and 6 illustrate the cross-sectional view as taken along the cross-sectional plane 74. In this embodiment, therefore, tip mass 66 is the total mass of toy 10 on the side of tip plane 70 indicated by arrows 72. The remainder mass 68 is the total mass of toy 10 to the side of tip plane 70 indicated by arrows 74.

In this arrangement, self-righting toy 10 spontaneously pivots along convex profile 38 of housing 12 on a horizontal surface 8 solely under gravitational force, and without a user-supplied force impulse. Such spontaneous pivoting of self-righting toy 10 is illustrated in FIGS. 5-6. As the user interacts with self-righting toy 10, weight 50 may move along pathway 44 to generate the "wobble" motion as the toy 10 continuously and spontaneously seeks to pivot upright with tip mass 66 gravitationally down and remainder mass 68 gravitationally up. It is contemplated that the action of self-righting toy 10 is most efficiently observed when toy 10 is operated on a smooth, hard, level horizontal surface 8.

The invention has been described herein in considerable detail in order to comply with the patent statutes, and to provide those skilled in the art with the information needed to apply the novel principles and to construct and use embodiments of the invention as required. However, it is to be understood that various modifications can be accomplished without departing from the scope of the invention itself.

What is claimed is:

1. A self-righting toy, comprising:

a housing having a housing axis defining an axial direction and a radial direction, said housing having a convexly curved outer surface and defining a chamber;

a wall at least in part defining a pathway extending around the housing axis in the chamber;

a weight confined to and movable along the pathway, said weight having a center of gravity;

wherein said housing and said weight together define an arcuate tip boundary such that when said weight center of gravity is disposed radially outwardly from the arcuate tip boundary, said housing is spontaneously pivotable on the curved outer surface about one or more pivot axes under solely gravitational force, and wherein the pathway is configured to maintain said weight center of gravity radially outward from the arcuate tip boundary.

2. A self-righting toy as in claim 1 wherein an entirety of the pathway is radially outward from the arcuate tip boundary.

3. A self-righting toy as in claim 1 wherein said one or more pivot axes are non-coincident with said housing axis.

4. A self-righting toy as in claim 1 wherein said weight includes one or more weight elements.

5. A self-righting toy as in claim 4 wherein said weight includes a ball.

6. A self-righting toy as in claim 1 wherein said housing is substantially torus-shaped, arranged circumaxially about said housing axis.

7. A self-righting toy as in claim 6 wherein said housing axis extends through an open core region bounded by said housing.

8. A self-righting toy as in claim 7 wherein the arcuate tip boundary extends along a constant radius from said housing axis.

9. A self-righting toy as in claim 8 wherein said arcuate tip boundary is circular.

10. A self-righting toy as in claim 9 wherein said curved outer surface exhibits a constant radius of curvature.

11. A self-righting toy as in claim 8 wherein said pathway is circular.

12. A self-righting toy as in claim 1 wherein said housing is induced into pivoting on the curved outer surface when a tip mass radially outwardly from a tip plane that is tangential to the arcuate tip boundary at an intersection with a cross-sectional plane passing through the housing axis and the weight center of gravity exceeds a remainder mass of a remainder of the toy not radially outward from the tip plane.

13. A self-righting toy as in claim 12 wherein the tip mass includes a portion of a housing mass, and a portion of a weight mass.

14. A self-righting toy as in claim 13 wherein the remainder mass includes less than all of the housing mass.

15. A self-righting toy as in claim 14 wherein the pathway is configured to continuously maintain the tip mass in excess of the remainder mass.

16. A self-righting toy, comprising:

a housing having a housing axis defining an axial direction and a radial direction, said housing having a base and a peripheral portion extending curvilinearly from a border of the base to form a convex profile, with said housing defining a chamber;

an annular wall extending at least partially circumaxially about the housing axis, and at least in part defining a planar endless pathway extending around the housing axis in said chamber;

a weight confined to and movable along the endless pathway, said weight defining a dynamic mass that is sufficient to induce said housing to spontaneously pivot along the convex profile in coordination with a position of the weight in the endless pathway, wherein the position of the weight is maintained by the endless pathway to continuously maintain a tip condition in which said housing is spontaneously pivotable along the convex profile.

17. A self-righting toy as in claim 16 wherein said annular wall and said peripheral portion of said housing together form the endless pathway.

18. A self-righting toy as in claim 17 wherein said annular wall is part of said housing.

19. A self-righting toy as in claim 16 wherein said weight includes a ball.

20. A self-righting toy as in claim 19 wherein the ball is maintained in contact with said annular wall and said peripheral portion of said housing.

21. A self-righting toy, comprising:

a housing having a housing axis defining an axial direction and a radial direction, said housing having a convex outer surface, and said housing defining a chamber;

a channel extending at least partially about the housing axis in said chamber, and defining a substantially planar arcuate pathway in said chamber;

a weight movably disposed in said channel, with said channel being configured to confine movement of said weight to along the defined pathway, said movable weight comprising a dynamic mass that is sufficient to induce said housing to spontaneously pivot along the convex outer surface in coordination with a position of said weight along the defined pathway, wherein the position of said weight is maintained by said channel to continuously maintain a tip condition in which said housing is spontaneously pivotable along the convex outer surface.

22. A self-righting toy as in claim 21, wherein said housing is spontaneously pivotable in the tip condition on a horizontal flat surface.

23. A self-righting toy as in claim 21 wherein said channel is formed in part by an annular wall extending circumaxially about said housing axis.

24. A self-righting toy as in claim 23 wherein said channel is further formed by a stub wall extending inwardly into said chamber.

25. A self-righting toy as in claim 21 wherein said substantially planar arcuate pathway is a constant radial distance from said housing axis.

* * * * *